US007768471B2

(12) United States Patent
Su et al.

(10) Patent No.: US 7,768,471 B2
(45) Date of Patent: Aug. 3, 2010

(54) DIPOLE ANTENNA DEVICE AND DIPOLE ANTENNA SYSTEM

(75) Inventors: Saou-Wen Su, Taipei (TW); Jui-Hung Chou, Tai-Chung (TW)

(73) Assignees: Silitek Electronic (Guangzhou) Co., Ltd., Guangzhou (CN); Lite-On Technology Corp., Taipei (TW)

( * ) Notice: Subject to any disclaimer, the term of this patent is extended or adjusted under 35 U.S.C. 154(b) by 8 days.

(21) Appl. No.: 12/050,940

(22) Filed: Mar. 19, 2008

(65) Prior Publication Data

US 2009/0128439 A1 May 21, 2009

(30) Foreign Application Priority Data

Nov. 16, 2007 (TW) ..... 96143526 A

(51) Int. Cl.
*H01Q 9/28* (2006.01)

(52) U.S. Cl. ..... 343/795; 343/820

(58) Field of Classification Search ..... 343/795, 343/793, 803, 820, 821, 700 MS
See application file for complete search history.

(56) References Cited

U.S. PATENT DOCUMENTS

| | | | | |
|---|---|---|---|---|
| 6,483,476 | B2 * | 11/2002 | Cox | 343/815 |
| 6,608,600 | B2 * | 8/2003 | Eriksson | 343/797 |
| 6,621,464 | B1 | 9/2003 | Fang | |
| 6,624,793 | B1 | 9/2003 | Su | |
| 6,961,028 | B2 * | 11/2005 | Joy et al. | 343/895 |
| 7,271,769 | B2 * | 9/2007 | Asano et al. | 343/702 |
| 2006/0284780 | A1 | 12/2006 | Chen | |

* cited by examiner

*Primary Examiner*—Hoang V Nguyen
(74) *Attorney, Agent, or Firm*—Kile Goekjian Reed & McManus PLLC

(57) ABSTRACT

A dipole antenna device includes a first metal piece including at least one bending part and a first feeding point; a second metal piece including a second bending part and a second feeding point; and a third metal piece electrically connected to a first connection point of the first metal piece and a second connection point of the second metal piece; wherein the first metal piece and the second metal piece are not electrically connected to each other except the first connection point and the second connection point.

12 Claims, 8 Drawing Sheets

DIPOLE ANTENNA DEVICE AND DIPOLE ANTENNA SYSTEM

BACKGROUND OF THE INVENTION

1. Field of the Invention

The present invention relates to an antenna device and an antenna system, and particularly relates to a dipole antenna device and a dipole antenna system.

2. Description of the Prior Art

The antenna utilized in a conventional 2.4-GHz wireless LAN or in a system using a 802.11b/g/n dipole antenna is usually an external antenna with a plastic or rubber sleeve surrounding it. Such antennas, on average, have a height of 8 to 10 cm and are located on one side of an apparatus, prone to be vandalized, and affect the aesthetic look of the apparatus. Additionally, a conventional internal dipole antenna is a printed antenna structure, and a signal is fed to the antenna via a mini-coaxial cable. However, since the two radiating metal pieces of the antenna are separate, the antenna can not be manufactured from a single metal plate, giving the printed antenna a higher cost. Related U.S. Pat. No. 6,621,464B1, U.S. Pat. No. 6,624,793B1, US20060284780A1 disclose a "dual-band dipole antenna." The dual-band dipole antenna obtains a dual-band operation by inserting slits or slots thereon and changing the length of the radiating metal piece. However, the above-mentioned antennas all have separate antenna radiating metal pieces, such that the manufacturing thereof must use a printed circuit process, thereby increasing the manufacturing cost of the antenna.

SUMMARY OF THE INVENTION

Therefore, the present invention discloses a dipole antenna device and an antenna system, which can be made of a single metal plate, thereby decreasing the antenna manufacturing cost.

One embodiment of the present invention discloses a dipole antenna device that comprises: a first metal piece, including at least one bending part, and a first feeding point; a second metal piece, including a second bending part, and a second feeding point; and a third metal piece, electrically connected to a first connection point of the first metal piece and a second connection point of the second metal piece; wherein the first metal piece and the second metal piece are not electrically connected to each other except at the first connection point and the second connection point.

Another embodiment of the present invention discloses a dipole antenna system that comprises: a first metal piece, including at least one bending part, and a first feeding point; a second metal piece, including a second bending part, and a second feeding point; and a third metal piece, electrically connected to a first connection point of the first metal piece and a second connection point of the second metal piece; and at least one transmission line, including an inner conductor and an outer braided shielding, electrically connected to the first feeding point and the second feeding point, respectively; wherein the first metal piece and the second metal piece are not electrically connected to each other except at the first connection point and the second connection point.

Another embodiment of the present invention discloses a dipole antenna device that comprises: a first metal piece, including at least a first slit and a first feeding point; a second metal piece, including at least a second slit and a second feeding point; and a third metal piece, electrically connected to a first connection point of the first metal piece and a second connection point of the second metal piece; wherein the first metal piece and the second metal piece are not electrically connected to each other except at the first connection point and the second connection point.

Still another embodiment of the present invention discloses a dipole antenna system comprising: a first metal piece, including at least one first slit and a first feeding point; a second metal piece, including at least one second slit and a second feeding point; and a third metal piece, electrically connected to a first connection point of the first metal piece and a second connection point of the second metal piece; and at least one transmission line, including an inner conductor and an outer braided shielding, electrically connected to the first feeding point and the second feeding point, respectively; wherein the first metal piece and the second metal piece are not electrically connected to each other except at the first connection point and the second connection point.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
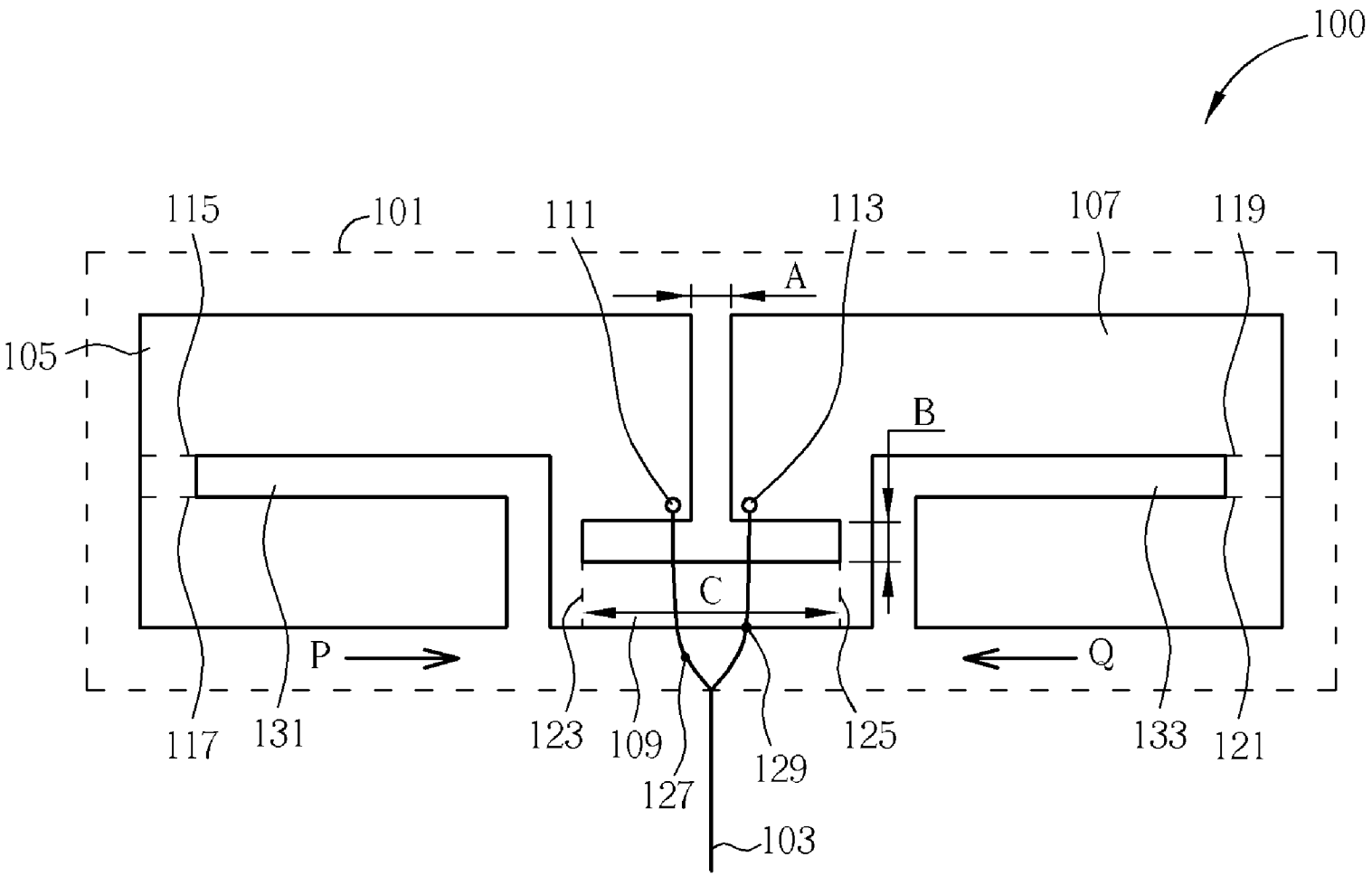
FIG. 1 illustrates a dipole antenna device according to a first embodiment of the present invention and a dipole antenna system utilizing the dipole antenna device.

FIG. 1 illustrates a dipole antenna device 101 according to a first embodiment of the present invention and a dipole antenna system utilizing the dipole antenna device 100. As shown in FIG. 1, the dipole antenna system 100 includes a dipole antenna device 101 and a transmission line 103. The dipole antenna device 101 includes a first metal piece (i.e., a radiating arm) 105, a second metal piece (i.e., a radiating arm) 107 and a third metal piece (i.e., a shorting strip) 109. The first metal piece 105 includes at least one bending part 115, 117 and a first feeding point 111. The second metal piece 107 includes at least a second bending part 119, 121, and a second feeding point 113. The third metal piece 109 is electrically connected to a first connection point 123 of the first metal piece 105 and a second connection point 125 of the second metal piece 107. The first metal piece 105 and the second metal piece 107 are not electrically connected to each other except at the first connection point 123 and the second connection point 125. The transmission line 103 includes an inner conductor 127 and an outer braided shielding 129, electrically connected to different feeding points. In this case, the inner conductor 127 is electrically coupled to the first accessing point 111, and the outer braided shielding 129 is electrically coupled to the second feeding point 113, but is not meant to limit the scope of the present invention.

Since a third metal piece 109 is provided between the first metal piece 105 and the second metal piece 107, the antenna device can be constructed by stamping or cutting a single metal plate, thereby decreasing the manufacturing cost. Additionally, the impedance matching and achievable bandwidth can be determined according to at least one of the following: a distance A between the first metal piece 105 and the second metal piece 107, a distance B between the feeding points 111, 113 and the third metal piece 109, and a length C of the third metal piece 109.

Figure 2:
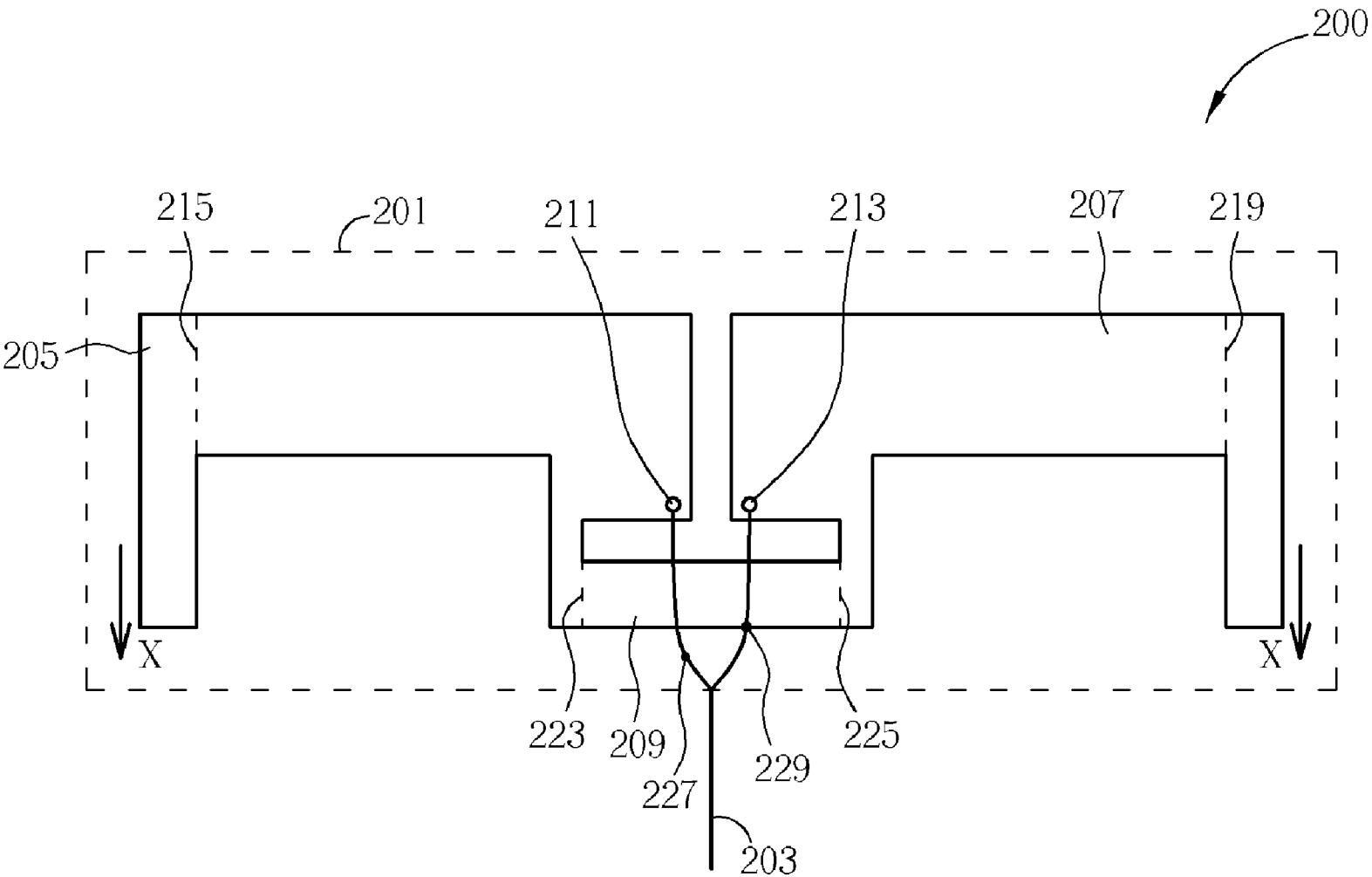
FIG. 2 illustrates a dipole antenna device according to a second embodiment of the present invention and a dipole antenna system utilizing the dipole antenna device.

It should be noted that the antenna device according to the present invention is not limited to the embodiment shown in FIG. 1. For example, the antenna device can include different bending parts, and the first and second metal pieces can be bent in different directions. FIG. 2 illustrates a dipole antenna 201 according to a second embodiment of the present invention and a dipole antenna system 200 utilizing the dipole antenna device. As shown in FIG. 2, the dipole antenna system 200 includes the same device and structure as the dipole antenna system 100 shown in FIG. 1. That is, the dipole antenna system 200 also includes a dipole antenna device 201 and a transmission line 203. The first metal piece 205 and the second metal piece 207 respectively have a first feeding point 211 and a second feeding point 213. Similarly, in this case, the inner conductor 227 is electrically coupled to the first accessing point 211, and the outer braided shielding conductor 229 is electrically coupled to the second feeding point 213. Also, the third metal piece 209 is electrically connected to the first connection point 223 and the second connection point 225.

One difference between the dipole antenna system 100 and the dipole antenna system 200 is that the first metal piece 105 includes two bending parts 115 and 117, and the second metal piece 107 includes two bending parts 119 and 121. Also, the first metal piece 105 and the second metal piece 107 are bent in different directions P and Q. However, in the dipole antenna system 200, the first metal piece 205 includes only a bending part 215, the second metal piece 207 includes only a bending part 219, and the first metal piece 205 and the second metal piece 207 bend in the same direction X.

Figure 3:
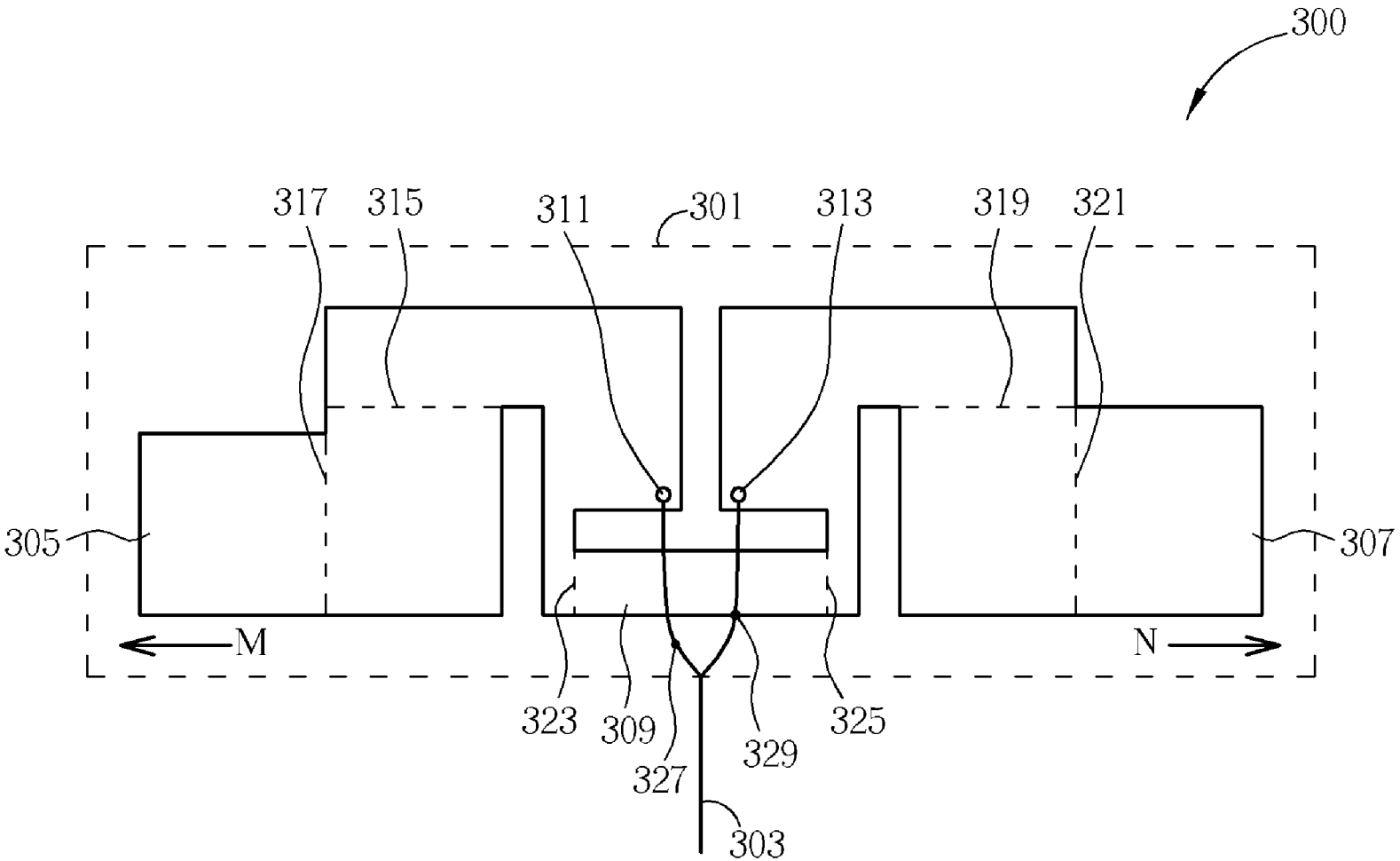
FIG. 3 illustrates a dipole antenna device according to a third embodiment of the present invention and a dipole antenna system utilizing the dipole antenna device.

According to the above-mentioned description, the dipole antenna device and the system are not limited to neither a specific number of bending parts nor a specific direction in the metal piece bends. FIG. 3 illustrates a dipole antenna device 301 according to a third embodiment of the present invention and a dipole antenna system 300 utilizing the dipole antenna device. As shown in FIG. 3, the dipole antenna system 300 includes similar device as in the dipole antenna systems 100 and 200: a dipole antenna device 301, a transmission line 303, a first metal piece 305, a second metal piece 307, a third metal piece 309, a first feeding point 311, a second feeding point 313, first bending parts 315, 317, second bending parts 319, 321, a first connection point 323, a second connection point 325, an inner conductor 327, and an outer braided shielding 329. Additionally, the first metal piece 305 and the second metal piece 307 of the dipole antenna system 300 each have two bending parts, as in the dipole antenna system 100, but are bent in different directions M and N.

According to the above-mentioned description, the concept of the present invention can be summarized as follows: electrically connect a third metal piece to a first metal piece and a second metal piece, the first metal piece and the second metal piece including at least one bending part, and the first metal piece and the second metal piece including at least one bending part that can be bent in the same or different directions. With this concept, the size and manufacturing cost of the antenna can decrease, and an antenna system can be designed as desired.

Please refer to FIG. 1 again, as described above, the first metal piece 105 of the dipole antenna system 100 can be bent in a P direction via the first bending parts 115, 117, and the second metal piece 107 can be bent in a Q direction via the second bending parts 119, 121. It can also be seen that the first metal piece 105 and the second metal piece 107 include slits 131 and 133, respectively. Therefore, the antenna system of the present invention can be summarized as including a first metal piece and a second metal piece, having a third metal piece connected to the first metal piece and the second metal piece, where the first and second metal pieces each include at least one slit. Also, the number and shapes of the slits in the first metal piece and the second metal piece are not limited to the dipole antenna system 100 shown in FIG. 1.

Figure 4:
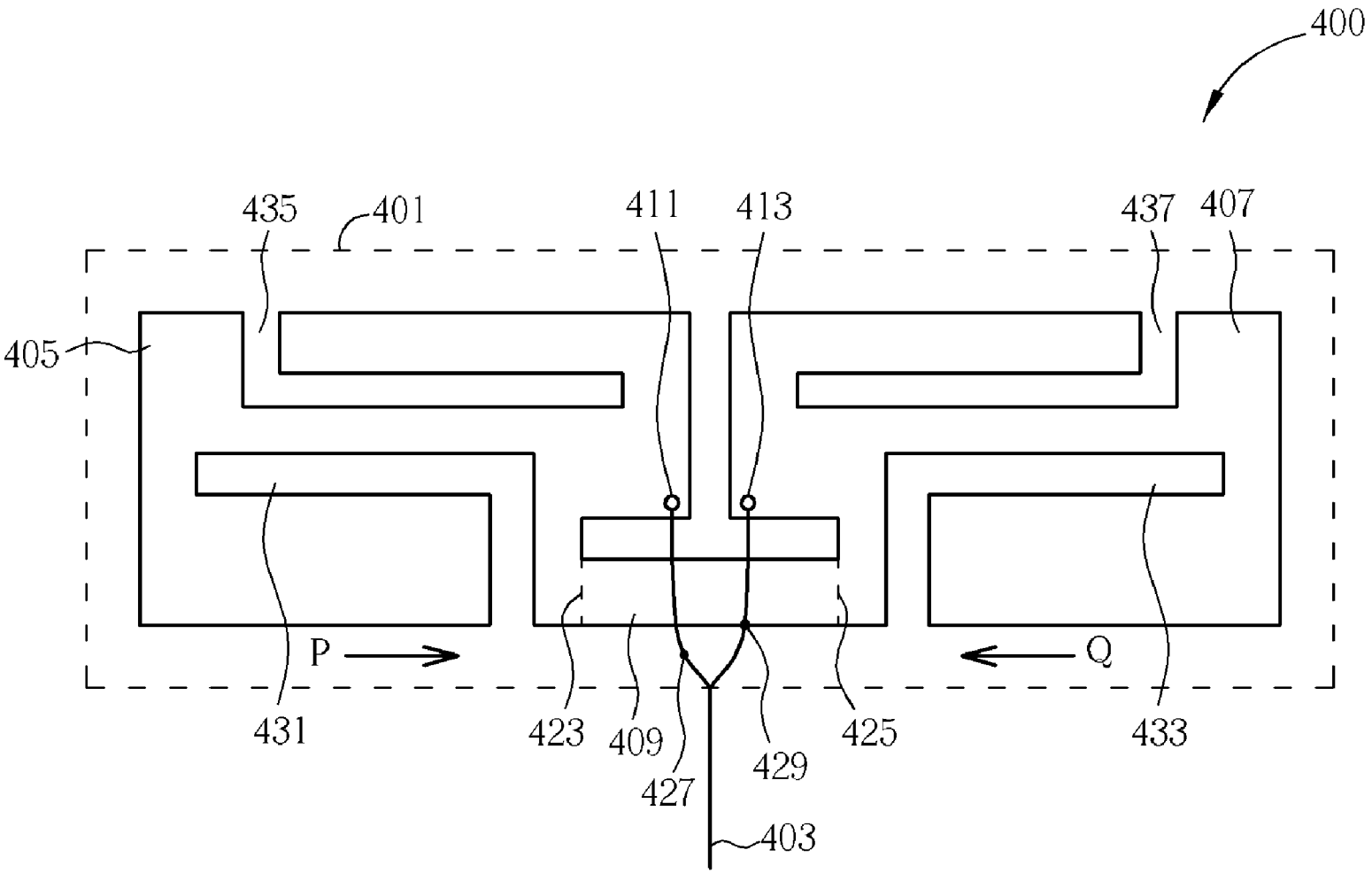
FIG. 4 illustrates a dipole antenna device according to a fourth embodiment of the present invention and a dipole antenna system utilizing the dipole antenna device.

FIG. 4 illustrates a dipole antenna device according to a fourth embodiment of the present invention, and a dipole antenna system utilizing the dipole antenna device. As shown in FIG. 4, the dipole antenna system 400 includes similar device as the dipole antenna system 100: a dipole antenna device 401, a transmission line 403, a first metal piece 405, a second metal piece 407, a third metal piece 409, a first feeding point 411, a second feeding point 413, a first connection point 423, a second connection point 425, an inner conductor 427, an outer braided shielding 429, and slits 431, 433. The difference between the dipole antenna system 400 and 100 is that the dipole antenna system 400 further includes slits 435, 437. As persons skilled in the art will note, each slit can change the resonant path of antenna excited surface currents. Therefore, desired antenna operating frequencies can be obtained by adjusting different slit positions, shapes, and lengths.

Figure 5:
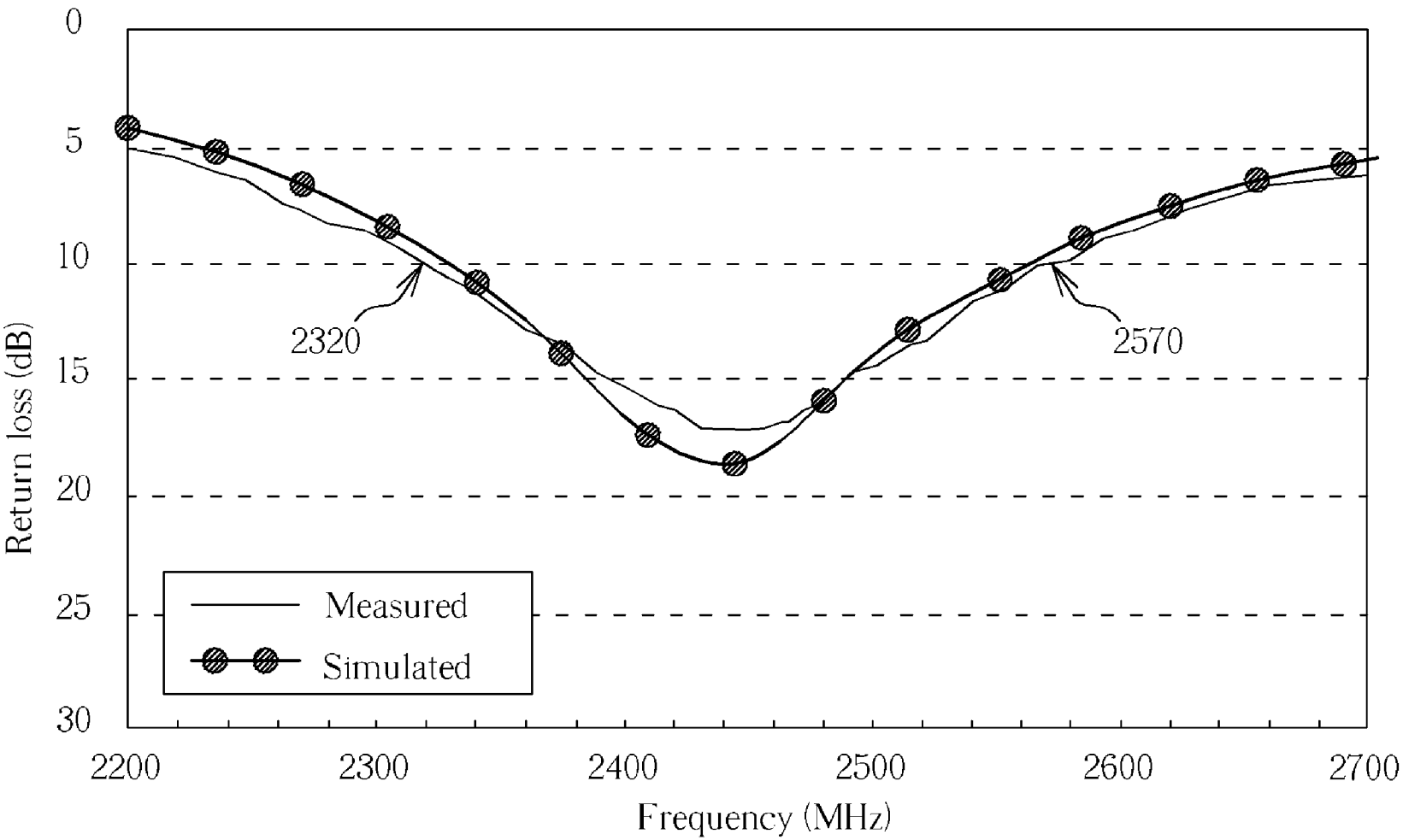
FIG. 5 is a schematic diagram illustrating simulated return loss, and the measured return loss of the dipole antenna device and the dipole antenna system according to embodiments of the present invention.

FIG. 5 is a schematic diagram illustrating simulated return loss, and the measured return loss of the dipole antenna device and the dipole antenna system according to embodiments of the present invention. As shown in FIG. 5, the 10-dB return-loss bandwidth exists in the range of 2320-2570 MHz. When a center frequency is set at 2442 MHz, a 10-dB return loss is matched and the ratio between the antenna bandwidth and the center frequency is about 10%, meeting the 2.4-GHz wireless LAN bandwidth requirement.

Figure 6:
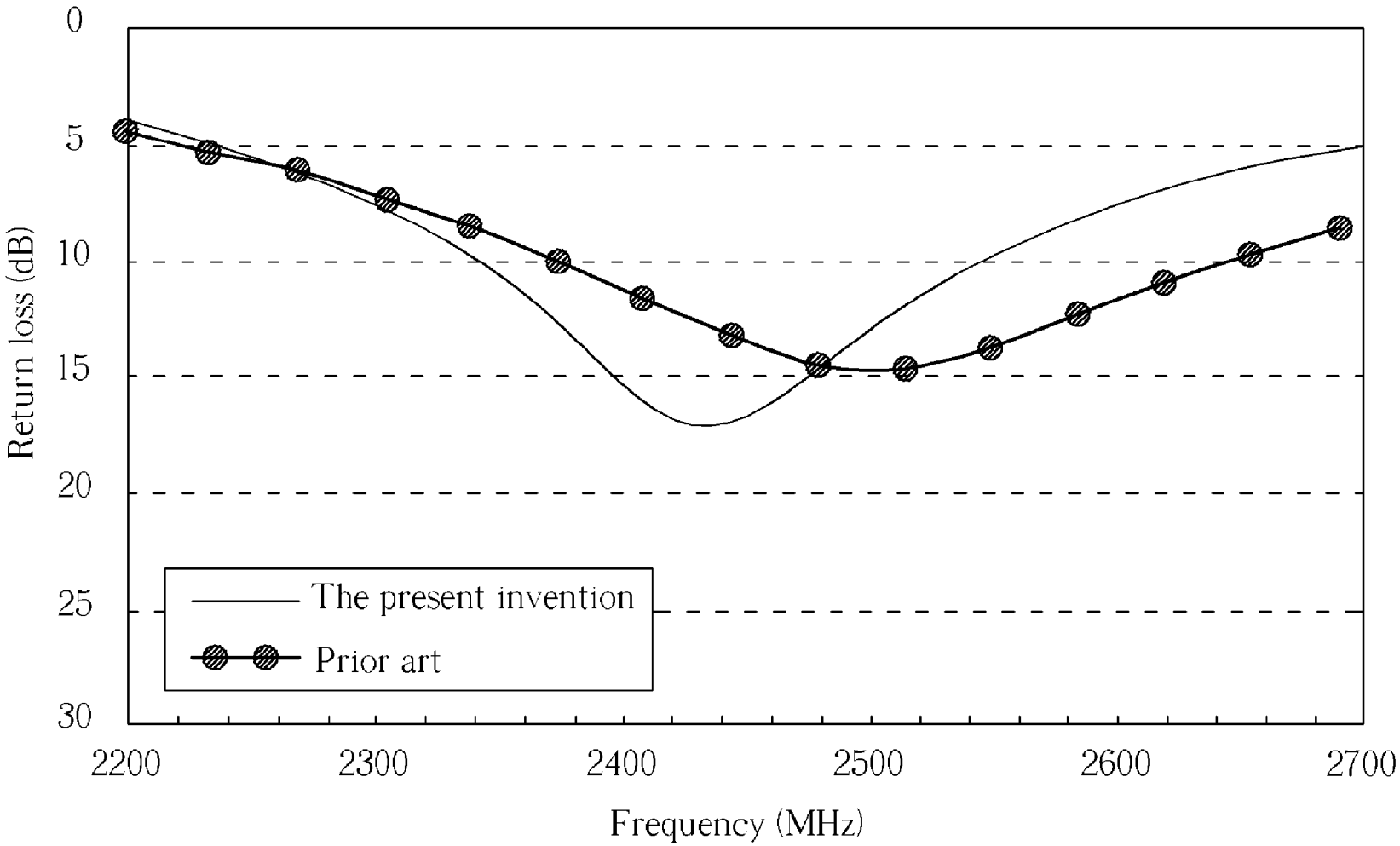
FIG. 6 is a schematic diagram illustrating a comparison of return loss of the dipole antenna device and system according to the embodiments of the present invention and a conventional dipole antenna device and system.

FIG. 6 is a schematic diagram illustrating the comparison of return loss of the dipole antenna device and system according to the embodiments of the present invention and of a conventional dipole antenna device and system. The conventional antenna device also includes a first metal piece and a second metal piece, but no third metal piece is provided between the first and second metal pieces. Also, the first and second metal pieces are respectively connected to the transmission line. As shown in FIG. 6, the prior art dipole antenna system has an operating bandwidth of about 2500 MHz, and the 10-dB return loss thereof is located between 2343 MHz to 2378 MHz. As known by persons skilled in the art, the operating bandwidth of the dipole antenna device can be adjusted by the radiating metal piece, i.e., the first and second metal pieces. Thus, when a prior art antenna system is desired to have the same functions as an antenna system according to the present invention, the length of the metal arm must be increased, and the size of the antenna will also increase accordingly. Thus, the antenna size can be decreased by utilizing an antenna system according to the present invention.

Figure 7:
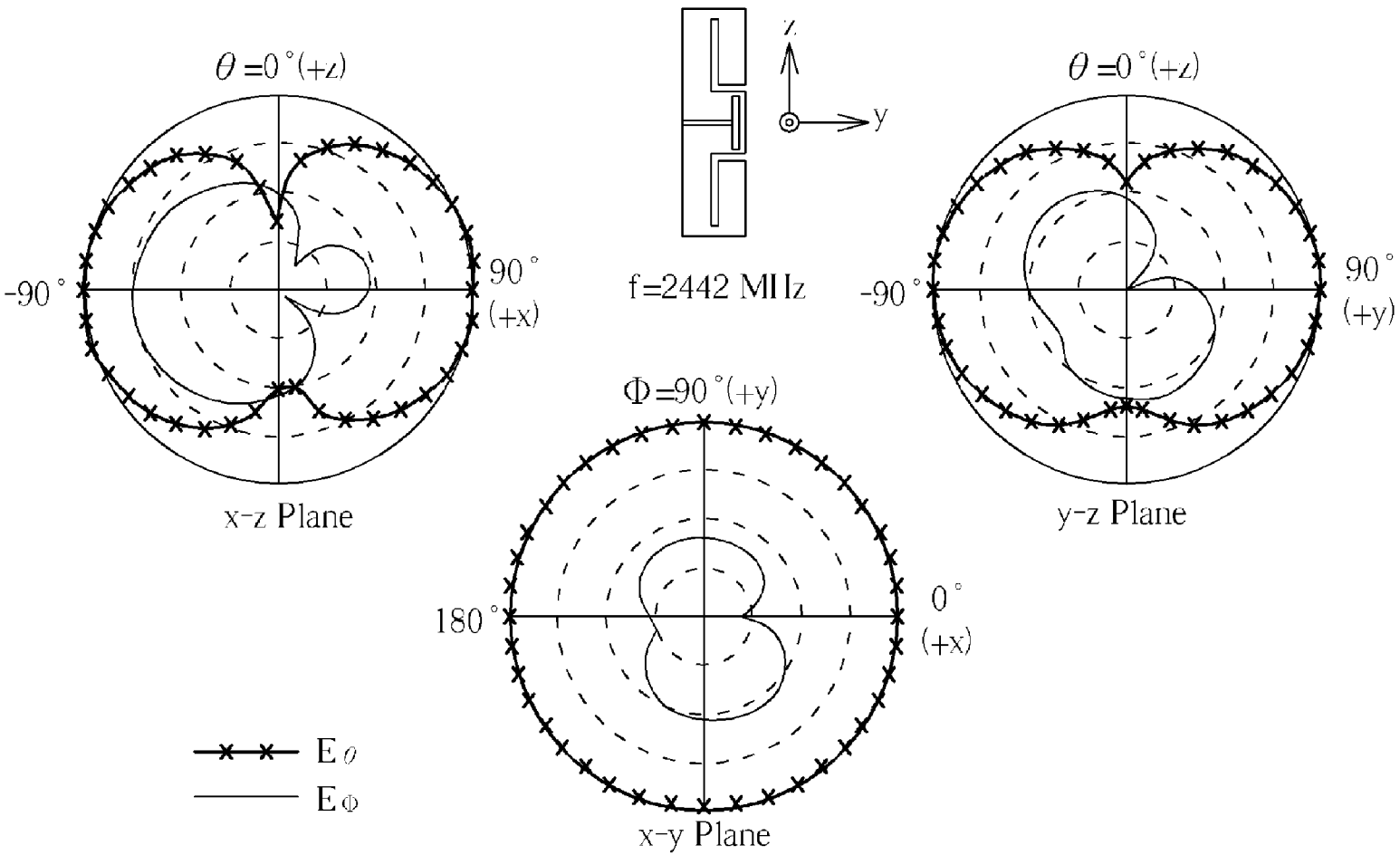
FIG. 7 is a measured radiation pattern of the dipole antenna device and system according to the embodiments of the present invention.

FIG. 7 is a measured radiation pattern of the dipole antenna device and system according to embodiments of the present invention. As shown in FIG. 7, the measured radiation pattern of the dipole antenna device and system according to the present invention has omnidirectional characteristics, substantially the same as a prior art dipole antenna device and system. Also, the radiation pattern of a dipole antenna device and system according to the present invention are symmetrical in the x-y plane.

Figure 8:
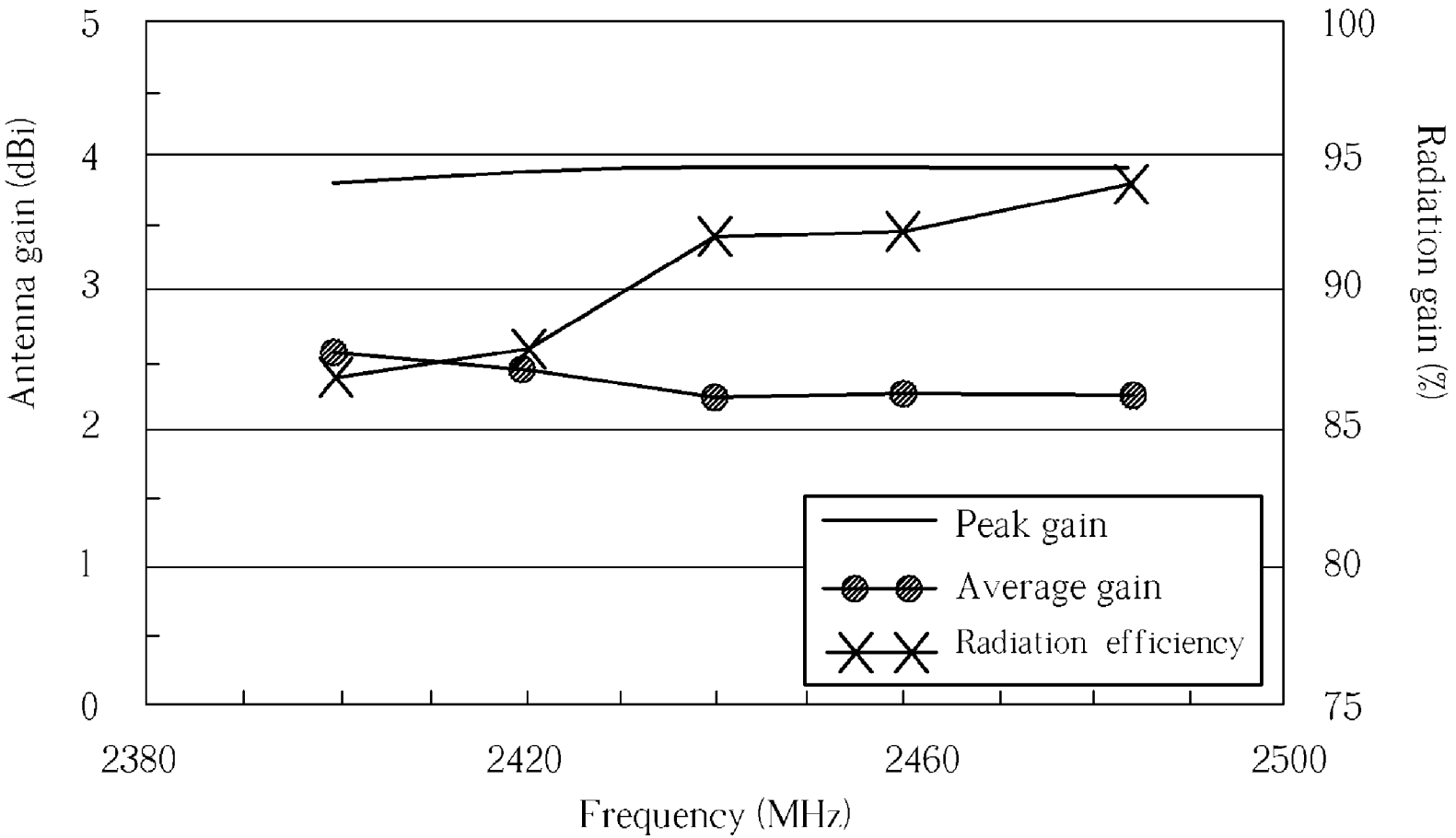
FIG. 8 is a schematic diagram illustrating measured the peak antenna gain curve and measured radiation gain efficiency curve of the dipole antenna device and system according to the embodiments of the present invention.

FIG. 8 is a schematic diagram illustrating the measured peak antenna gain curve and measured radiation gain efficiency curve of the dipole antenna device and system according to embodiments of the present invention. As shown in FIG. 8, the peak gain can reach 3.9 dBi, which is larger than an average gain by about 1.5 dBi in the 2.4 GHz band. Also, the radiation efficiency can reach 86% over the operating band.

As above-mentioned description, the antenna system according to the present invention can be manufactured from a single metal plate, decreasing the cost of antenna manufacturing. Also, the frequency and impedance matching can be adjusted without increasing the size, such that the antenna system can have good characteristics.

Those skilled in the art will readily observe that numerous modifications and alterations of the device and method may be made while retaining the teachings of the invention.

What is claimed is:

1. A dipole antenna device, comprising:

a first metal piece, including at least one bending part, and a first feeding point;

a second metal piece, including at least one second bending part, and a second feeding point; and a third metal piece, electrically connected to a first connection point of the first metal piece and a second connection point of the second metal piece;

wherein the third metal piece does not contact the first feeding point and the second feeding point, and the impedance matching or achievable bandwidth of the dipole antenna device corresponds to a distance between the third metal piece from the first feeding point, and a distance between the third metal piece and the second feeding point;

wherein the first metal piece and the second metal piece are not electrically connected to each other except the first connection point and the second connection point; wherein the first metal piece, the second metal piece and the third metal piece are constructed by stamping or cutting a single metal plate.

2. The dipole antenna device of claim 1, wherein the ends of the first metal piece and the second metal piece are bent towards the same direction.

3. The dipole antenna device of claim 1, wherein the ends of the first metal piece and the second metal piece are bent towards different directions.

4. A dipole antenna system, comprising:

a first metal piece, including at least one bending part, and a first feeding point;

a second metal piece, including at least one second bending part, and a second feeding point; and a third metal piece, electrically connected to a first connection point of the first metal piece and a second connection point of the second metal piece, wherein the third metal piece does not contact the first feeding point and the second feeding point, and the impedance matching or achievable bandwidth of the dipole antenna system corresponds to a distance between the third metal piece and the first feeding point, and a distance between the third metal piece and the second feeding point; and at least one transmission line, including an inner conductor and a outer braided shielding, electrically connected to the first feeding point and the second feeding point, respectively;

wherein the first metal piece and the second metal piece are not electrically connected to each other except the first connection point and the second connection point; wherein the first metal piece, the second metal piece and the third metal piece are constructed by stamping or cutting a single metal plate.

5. The dipole antenna system of claim 4, wherein the ends of the first metal piece and the second metal piece are bent towards the same direction.

6. The dipole antenna system of claim 4, wherein the ends of the first metal piece and the second metal piece are bent towards different directions.

7. A dipole antenna device, comprising:

a first metal piece, including at least one bending part, and a first feeding point;

a second metal piece, including at least one second bending part, and a second feeding point; and a third metal piece, electrically connected to a first connection point of the first metal piece and a second connection point of the second metal piece, wherein the third metal piece has a length between the first connection point and the second connection point, and the impedance matching or achievable bandwidth of the dipole antenna device corresponds to the length between the first connection point and the second connection point, or a distance between the first metal piece and the second metal piece;

wherein the first metal piece and the second metal piece are not electrically connected to each other except the first connection point and the second connection point; wherein the first metal piece, the second metal piece and the third metal piece are constructed by stamping or cutting a single metal plate.

8. The dipole antenna device of claim 7, wherein the ends of the first metal piece and the second metal piece are bent towards the same direction.

9. The dipole antenna device of claim 7, wherein the ends of the first metal piece and the second metal piece are bent towards different directions.

10. A dipole antenna system, comprising:

a first metal piece, including at least one bending part, and a first feeding point;

a second metal piece, including at least one second bending part, and a second feeding point; and a third metal piece, electrically connected to a first connection point of the first metal piece and a second connection point of the second metal piece, wherein the third metal piece has a length between the first connection point and the second connection point, and the impedance matching or achievable bandwidth of the dipole antenna system corresponds to the length between the first connection point and the second connection point, or a distance between the first metal piece and the second metal piece; and at least one transmission line, including an inner conductor and a outer braided shielding, electrically connected to the first feeding point and the second feeding point, respectively;

wherein the first metal piece and the second metal piece are not electrically connected to each other except the first connection point and the second connection point; wherein the first metal piece, the second metal piece and the third metal piece are constructed by stamping or cutting a single metal plate.

11. The dipole antenna system of claim 10, wherein the ends of the first metal piece and the second metal piece are bent towards the same direction.

12. The dipole antenna system of claim 10, wherein the ends of the first metal piece and the second metal piece are bent towards different directions.

* * * * *